US007490571B2

(12) United States Patent
Luxford

(10) Patent No.: US 7,490,571 B2
(45) Date of Patent: Feb. 17, 2009

(54) SWING AWAY STEERING WHEEL ASSEMBLY FOR A BOAT

(76) Inventor: Gary Luxford, 15 Patrick Street, Aitkenvale, 4814, Queensland (AU)

( * ) Notice: Subject to any disclaimer, the term of this patent is extended or adjusted under 35 U.S.C. 154(b) by 0 days.

(21) Appl. No.: 11/892,843

(22) Filed: Aug. 28, 2007

(65) Prior Publication Data

US 2008/0105182 A1 May 8, 2008

(30) Foreign Application Priority Data

Sep. 1, 2006 (AU) ..... 2006211857

(51) Int. Cl.
*B63H 25/04* (2006.01)

(52) U.S. Cl. ..... 114/144 R; 280/775

(58) Field of Classification Search ..... 114/114 R, 114/343, 364; 280/775
See application file for complete search history.

(56) References Cited

U.S. PATENT DOCUMENTS 2,629,356 A 2/1953 Whiting
4,299,407 A * 11/1981 Simson ..... 280/775
4,733,745 A * 3/1988 Lumpkins ..... 280/775
4,821,837 A * 4/1989 Fifer ..... 280/775
5,048,444 A 9/1991 Moore
5,372,082 A * 12/1994 Hattori ..... 114/144 R
5,632,353 A * 5/1997 Kimberley ..... 280/775
5,943,979 A * 8/1999 Hattori ..... 114/362
6,834,606 B2 12/2004 Berret et al.

FOREIGN PATENT DOCUMENTS

FR 2771997 12/1997
FR 2869587 4/2004
NL 1020039 2/2002

* cited by examiner

*Primary Examiner*—Lars A Olson
(74) *Attorney, Agent, or Firm*—Hoffman, Wasson & Gitler, P.C.

(57) ABSTRACT

A steering assembly for a boat has a steering wheel, a mounting means to which the steering wheel is attached, and attachment means to attach the mounting means to the boat, the mounting means being movable between a use position where the mounting means generally extends partially across the inside of the boat, and an away position where the mounting means has been moved generally against or more towards the hull of the boat.

15 Claims, 11 Drawing Sheets

SWING AWAY STEERING WHEEL ASSEMBLY FOR A BOAT

FIELD OF THE INVENTION

This invention is directed to a steering assembly (typically including a steering wheel) which can be swung between a use position and a storage position, with the steering assembly being substantially out of the way when in the storage position to increase the usable space inside the boat. The assembly can also be removed from a boat thereby making it impossible for an unauthorised person to use the boat.

BACKGROUND OF THE INVENTION

In the recreational boating industry, there are generally three types of powerboats being small boats (length 6-10 feet) medium-sized boats, and the large boats (which often made of fibreglass and have sleeping quarters, multiple levels etc).

Most of the small boats contain an outboard motor attached to the rear of the boat and a steering arm which is also at the rear of the boat. The boat can be steered by pushing or pulling the steering arm.

Many of the medium-sized boats have a more sophisticated steering arrangement which comprises a steering wheel mounted to some form of mounting means (such as a dashboard). The steering wheel is mounted such that the person operating the steering wheel faces forwardly and towards the prow of the boat. As a consequence, the steering wheel extends into the boat space and can take up a reasonable amount of boat space. These boats are manufactured from fibreglass, composite materials, metal (typically aluminum and steel) and the like.

Many recreational boats are used for fishing and when a desired fishing spot is obtained, the boat is anchored and the steering wheel is not required. There are, of course, many other times when the boat is anchored and the steering wheel is not required.

However, it is generally not possible, convenient and may even be quite dangerous to simply unbolt or remove the steering wheel and to store the steering wheel when not required. There would be in advantage if it were possible to move the steering wheel into an out of the way position without needing to unbolt the steering wheel.

It is known to provide a steering wheel mounted to a substantially vertical column and where the base of the column is pivotally mounted about a horizontal axis so that the column can pivot from one side of the boat to another side of the boat. This allows a person to either stand behind the steering wheel when the steering wheel is upright or sit on one side of the boat when the steering wheel is pivoted to that side or sit on the other side of the boat when the steering wheel is pivoted to the other side. French patent 2771997, and French patent 2869587 illustrate this design. This design however does not allow the steering wheel assembly to swing away to one side of the boat such that the inside of the boat is substantially free from any encumbrance from the steering wheel. In the French patent document, the steering wheel will still be in the way no matter where it is positioned.

U.S. Pat. No. 2,629,356 (1951) describes a steering wheel assembly mounted in the front of the boat and on a pair of horizontal spaced parallel rails. The rails extend transversely across the boat. The steering wheel can be slid anywhere along the rails and then locked into position. This design does not allow the steering wheel assembly to swing away to one side of the boat. Thus, the steering wheel will still be in the way no matter where it is positioned on the rails.

None of the above disclosures describe any cushioning ability should a person be thrown against a steering wheel (for instance in rough seas).

Misuse of boats or boat theft is also an issue, and security measures should be taken to secure a boat against theft or misuse. Various types of locking arrangements are known to lock the steering wheel or various parts or components of the boat such that the boat cannot be used. There would be an advantage if a better form of security arrangement could be provided.

With the smaller and mid sized boats which contain a steering wheel or something similar, the positioning of the steering wheel in front of the person means that the person can often strike the steering wheel or boat controls next to the steering wheel, especially if the boat is suddenly rocked by a wave. This can cause bruising to the person and possibly damage to the steering mechanism. There would be an advantage if some form of steering mechanism could be provided which may reduce possible bruising or damage to the steering mechanism.

BRIEF SUMMARY OF THE INVENTION

It is an object of the invention to provide a steering mechanism (typically a wheel) for a boat and which may overcome at least some of the above-mentioned disadvantages or provide a useful or commercial choice.

In one form, the invention resides in a steering assembly for a boat, the steering assembly comprising a steering device or something equivalent, a mounting means to which the steering wheel is attached, and attachment means to attach the mounting means to the boat, the mounting means being movable between a use position where the mounting means generally extends partially across the inside of the boat, and an away position where the mounting means has been moved generally against or more towards the hull of the boat.

It is also preferred that the steering assembly can be quite easily removed entirely from the boat to provide a measure of security. Thus, complicated and often quite ineffective locking devices are no longer required.

The steering assembly will usually contain a steering wheel as the steering device, and which can be rotatably mounted relative to the mounting means. The steering wheel may comprise a round steering wheel, or a steering wheel having a different shape. It is considered that the term "steering device" should include any type of device which can be operated by a person to ultimately steer the boat. Thus, the term "steering device"may include a solid disc which can be rotated, a bar or rod which can be rotated and the like.

In a more particular form, the invention comprises a steering assembly for a boat and which is a swingable between a use position where the steering assembly extends into the boat, and a retracted position where the steering assembly is against the side of the boat, the steering assembly comprising:

(a) a lower support adapted for attachment to the boat, (b) an upper support pivotally attached to the lower support for pivotal movement about a substantially vertical axis, (c) a dashboard attached to the upper support, (d) a steering device supported by the dashboard, and, (e) a biasing member attached to the dashboard and to a fixed position on the boat, the dashboard and the upper support being swingable relative to the lower support between a use position where the dashboard containing the steering device extends into the boat and a retracted position where the dashboard containing the steering device is against the side of the boat, the biasing member biasing the dashboard into the use position.

Suitably, the lower support comprises an upright post, a floor plate attached to a lower part of the upright post, the floor plate being attachable to the boat floor, the post being fixed in position and unable to rotate or otherwise move.

Suitably, the biasing member comprises a gas strut.

The steering assembly can be used on a narrow gunnel boat or a wide gunnel boat. To explain, the gunnel is the upper rail on the boat hull, and which provides strength to the upper edge of the hull. Small boats are typically provided with either a narrow gunnel or a wide gunnel. A narrow gunnel would include an upper edge having a width of less than 2 or 3 inches while a wide gunnel would include an upper edge having a width of more than 6 inches. The steering assembly according to the invention can be used on both a narrow gunnel boat or a wide gunnel boat, but a slight modification is required. The present invention therefore comprises two embodiments of the steering assembly one particularly suited for a narrow gunnel boat and one particularly suited for a wide gunnel boat.

In the figures, the narrow gunnel boat is illustrated in plan in FIG. 1 and FIG. 2 and a wide gunnel boat is illustrated in plan in FIG. 6 and FIG. 7.

In the embodiment, the steering assembly particularly suited for a narrow gunnel boat is illustrated in FIGS. 1-4, and FIGS. 8-13, while the steering assembly particularly suited for the wide gunnel boat is illustrated in FIGS. 5-7 and FIGS. 14-19.

The main difference in the steering assembly is in the positioning of the gas strut. In the narrow gunnel boat, the steering assembly contains an extending gas strut support arm to which the gas strut is attached while in the wide gunnel boat, the gas strut is attached to the gunnel itself (via a small mounting plate).

If the steering assembly is used in a narrow gunnel boat, the assembly typically has a gas strut mounting arm extending outwardly from the upright post and fixedly attached to the upright post, one end of the gas strut being attached to the gas strut mounting arm and the other end of the gas strut being attached to the dashboard, the gas strut mounting arm extending substantially at right angles relative to the dashboard when the dashboard is in the use position.

Suitably, gas strut is attached to the dashboard at a mounting point, the mounting point being positioned on the dashboard such that as the dashboard is swung from the extended use position to the retracted nonuse position, the mounting point passes from one side of the mounting arm to the other side of the mounting arm to provide an over centre mechanism, thereby biasing the dashboard both in the retracted nonuse position and in the extended use position.

If the steering assembly is used in a wide gunnel boat one end of the gas strut is typically attached to the dashboard and the other end of the gas strut is fixed relative to the gunnel of the boat.

With the wide gunnel boat, the dashboard typically extends at least partially over the top of the gunnel when the dashboard is in the nonuse position.

With the wide gunnel boat, the gas strut is typically attached to the dashboard and a mounting point, the mounting point being positioned on the dashboard such that as the dashboard is swung from the extended use position to the retracted nonuse position, the mounting point extends past the attachment of the gas strut relative to the gunnel of the boat to provide an over centre mechanism thereby biasing the dashboard both in the retracted nonuse position and in the extended use position.

Suitably, the steering assembly has a limit member which prevents the dashboard from swinging entirely past the wide gunnel.

The limit member typically comprises a rigid elongate finger, a lower end of which is fixed to the lower post and an upper end of which abuts against part of the dashboard when the dashboard is swung into the retracted nonuse position to prevent over rotation of the dashboard.

The upper support can be removed from the lower support thereby enabling the dashboard and the steering device to be removed from the boat, for safety and security against theft.

Suitably, the post of the lower support has an open upper end, and the upper support to which the dashboard is attached has a lower end which passes into the open upper end of the lower support to enable the upper support to swing relative to the lower support and which enables the upper support to be removed from the lower support.

Suitably, a locking member is provided and which is a threaded fastener which passes through an opening in the lower support, the upper support having a lower part circumferential slot into which the threaded fastener can locate thereby enabling the upper part to swing relative to the lower part but preventing the upper part from being lifted out of the lower part.

Suitably, an elongate throttle mounting plate is attached to the upright post and extending substantially parallel to the boat gunnel, the throttle mounting plate enabling a throttle to be mounted to the mounting plate.

The dashboard will typically comprise a front plate to which the steering wheel can be attached, and a rear cover. Inside the dashboard will be the mechanism to enable the steering wheel to control the outboard motor or rudder of the boat. Control lines (typically wires) are widely used to connect the steering wheel to the outboard motor etc.

The dashboard can move between the use and the "away" position and because it is also desirable that the entire steering assembly can be removed from the boat, it is considered that the mounting means should not be made to large, too bulky or too heavy thereby making removal more difficult.

The dashboard may be made of any suitable material such as metal (typically steel or aluminium), plastics, laminates, wood, and the like. The size and shape of the dashboard can vary but it is considered desirable that the dashboard is relatively small such that it does not unnecessarily protrude into the available space in the boat.

The dashboard may include some form of arm member to which the steering wheel can be attached. The arm member may comprise a single elongate member or may comprise a pair of arm members which are spaced apart, or may comprise a "U-shaped" arm member and the like.

It is considered desirable that the dashboard is strong enough to support the steering wheel but not unnecessarily large or bulky to make it more difficult to freely move around in the boat.

In a simple form, the lower support may comprise a bracket, a socket, and the like to which the upper support can be fitted. It may be necessary to have more than one lower support to ensure a secure attachment of the mounting means relative to the boat hull.

The lower support is typically fixed to a part of the boat and it is envisaged that the lower support will remain permanently attached to the boat. This can be achieved by any suitable means such as the use of fasteners, by welding, clamping, and the like. The lower support may also be an integral part of some other parts of the boat.

Alternatively, the lower support may be removably attached to the boat.

It is also envisaged that the lower support may comprise a more complex arrangement containing a first part which may be attached to the boat and a second part which may be attached to the upper support These two parts may be attached together either releasably or in a hinge manner or some other way.

The upper support preferably contains a leg member or post member which can attached to, or relative to the lower support It is preferred that the upper support can move relative to the lower support between the use position and the "away" position. Thus, the upper support may be fixed relative to the lower support in such a way that it can swing between the positions.

It is also preferred that the arrangement with the lower support and the upper support is such that the upper support containing the dashboard can be quite easily removed from the lower support to allow the steering assembly to be removed from the boat.

If desired, the lower support can be attached to the boat at a plurality of different positions thereby enabling the steering assembly to be fitted in different places in the boat (for instance more to the front of the boat or more to the rear of the boat). Thus, the boat may be provided with a plurality of spaced apart places to which the lower support can be attached.

It is also envisaged that the boat may be provided with at least one and typically two or more rails attached to the sidewall of the boat and that the lower support can be attached to the rails in such a manner that the attachment means can move along the rails to a desired position and then locked in place. The locking can be done by any suitable means including some form of cam lock, or a "pin in slot" lock, a clamp and the like. The rails may be provided with a plurality of openings and the attachment means may be provided with a pin or hook or something similar such that the lower support can be fastened to the rails at various different positions.

An advantage with the "swinging" ability of the steering assembly is that some form of cushioning means can be provided. In one form, the cushioning means can comprise a gas strut or something similar. One end of the strut can be fastened to some place in the boat and the end of the strut can be attached to some part of the steering assembly. Thus, the steering assembly can be biased or "held" in the extended use position but if a person is pushed against the steering assembly, the steering assembly will move slightly towards the "away" position to cushion the person and will then return to the extended use position.

Alternatively, the cushioning means may comprise a spring. The spring can be provided about the post member or leg member of the upper support to naturally bias the steering assembly into the use position. It is also envisaged that some form of spring arrangement can be positioned at or adjacent the lower support.

Other types of cushioning means are envisaged including elastic cushioning means, resilient cushioning means, hydraulic or pneumatic means and the like.

The upper support can be configured to allow other devices to be attached to, or supported by the mounting means including operating controls, various gauges or dials, a radio, a depth sounder, and the like. Another advantage of this is that removal of the upper support relative to the lower support will also remove and keep safe these various attachments.

The upper support containing the dashboard, when in the use position, will extend generally across the inside of the boat. Typically, the upper support and dashboard will be positioned such that the person behind the steering wheel will face the front (prow) of the boat. However, it is envisaged that the upper support may also adopt some angles although this may create some disorientation to the person steering the boat. Therefore, while it is considered that the use position will be where the upper support/dashboard is substantially at right angles to the boat hull portion to which the upper support is attached, it is not considered that the invention should be limited to this precise angle.

Similarly, when the upper support is in the "away" position, this is meant to include that the upper support has been swung away from the use position and typically substantially against the hull of the boat such that the steering wheel is no longer in the way. However, it is not considered that the term "away" position should be limited only to the position where the mounting means is against the hull of the boat.

BRIEF DESCRIPTION OF THE DRAWINGS

Two embodiments of the invention will be described with reference to the following drawings in which:

FIG. 12 with the plan view of FIG. 11 which is the side elevation view).

DETAILED DESCRIPTION OF THE INVENTION

Figure 6:
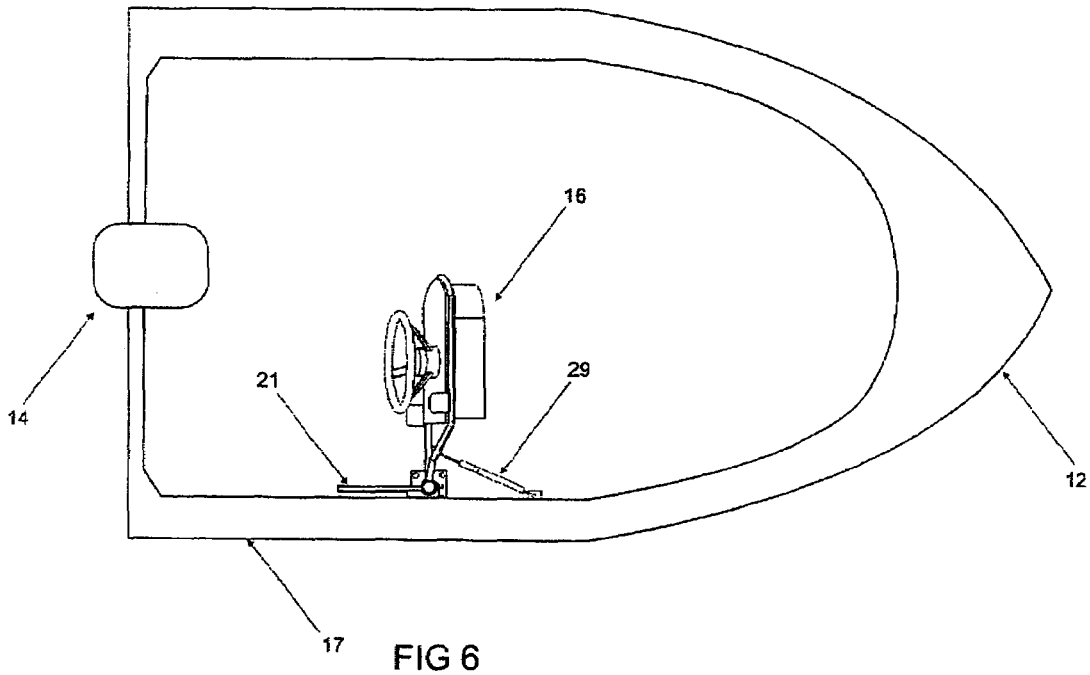
FIG. 6. Illustrates a plan view of the steering wheel assembly of the second embodiment of the invention in the use position and on a wide gunnel boat.
Figure 7:
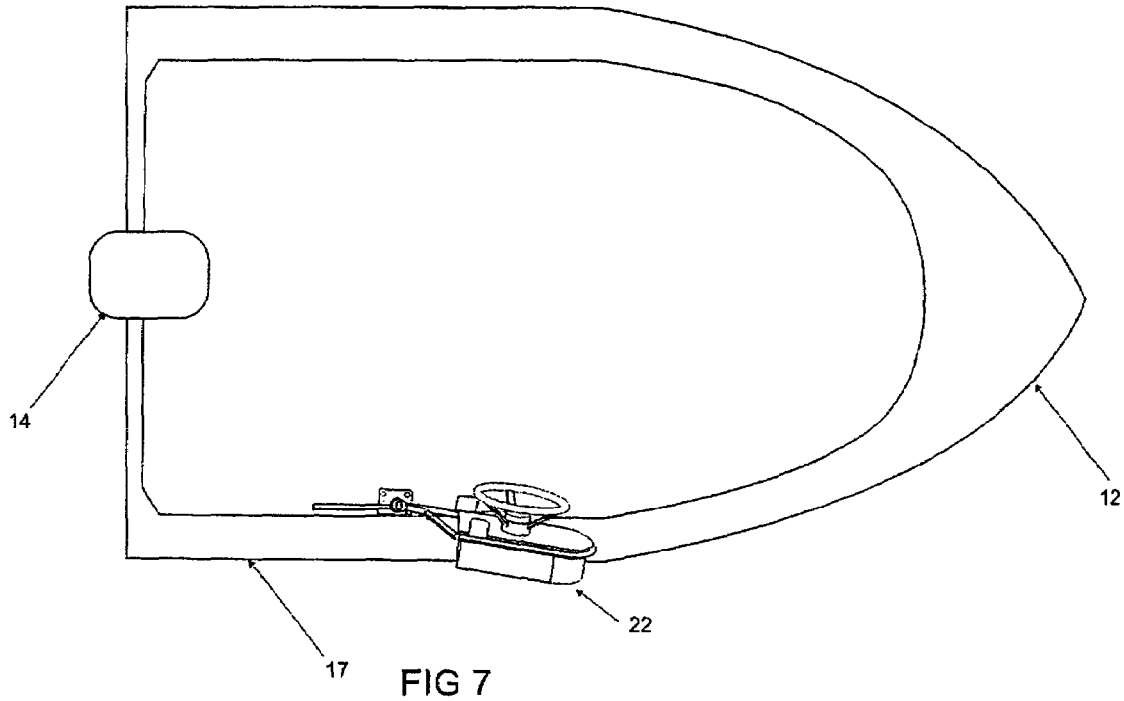
FIG. 7. Illustrates the plan view of FIG. 6 with the steering wheel assembly swung away into the nonuse position and on a wide gunnel boat.

Referring to the drawings there is illustrated a steering wheel assembly for use with a narrow gunnel boat (see for instance FIG. 1 and FIG. 2) and a steering wheel assembly of slightly different design for use with a wide gunnel boat (see for instance FIG. 6 and FIG. 7). The steering wheel assembly is essentially the same for each version.

Figure 1:
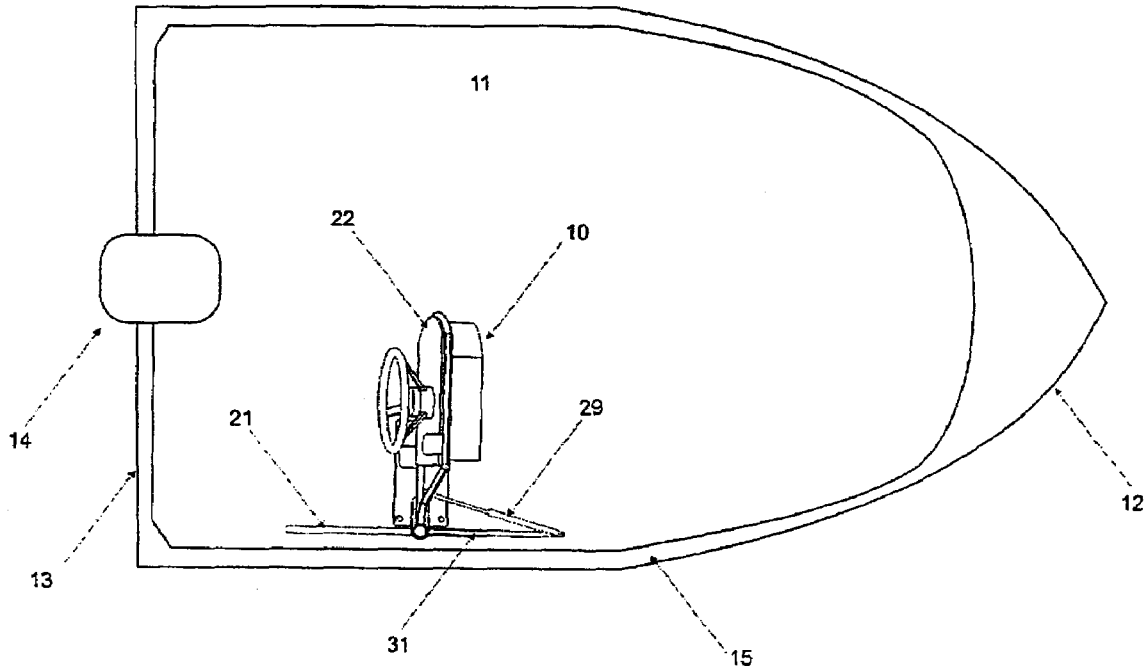
FIG. 1. Illustrates a plan view of a steering wheel assembly in the use position and in a narrow gunnel boat.

Referring initially to FIG. 1, there is shown a steering wheel assembly 10 for a boat and particularly a boat having a length of between 6-24 feet. The boat 11 has a front prow 12 and a rear end 13 to which an outboard motor 14 can be attached. The boat of FIG. 1 is a "narrow gunnel" boat which means that the upper edge or gunnel 15 is fairly narrow and typically has a width of between 1-2 inches. Briefly, in FIG. 1, the steering wheel assembly 10 is in the extended use position and in FIG. 2, the steering wheel assembly 10 has been pushed against the side of the boat into a retracted nonuse (folded) position. Although it is not envisaged that the steering wheel assembly will be used when pushed against the side of the boat and therefore the steering wheel assembly is considered to be in the "non use" position, there may be circumstances where there may be some advantage in still operating the steering wheel when in this swung away position.

Importantly, the steering wheel assembly is of the type that can swing away between the use position (FIG. 1) and the nonuse position (FIG. 2) as opposed to other systems which use slide rails to slide the steering wheel from one side of the boat to the other side of the boat or where the steering wheel is in the middle of the boat and can pivot from the left hand side of the boat to the right hand side of the boat.

Referring to FIG. 6, there is shown an essentially identical steering wheel assembly 16 but this time fitted to a wide gunnel boat 17 which has a gunnel 18 having a width of between 6 inches up to 12 inches. In FIG. 6, the steering wheel assembly 16 is in the use position and in FIG. 7, the steering wheel assembly has been swung to the nonuse position.

One difference between the narrow gunnel steering wheel assembly and the wide gunnel steering wheel assembly can be seen. In FIG. 7, the steering assembly has been swung over the top of the gunnel. In the narrow gunnel version (FIG. 2), the steering wheel is swung more against the inside edge of the boat/gunnel. This will be explained in greater detail below.

Figure 2:
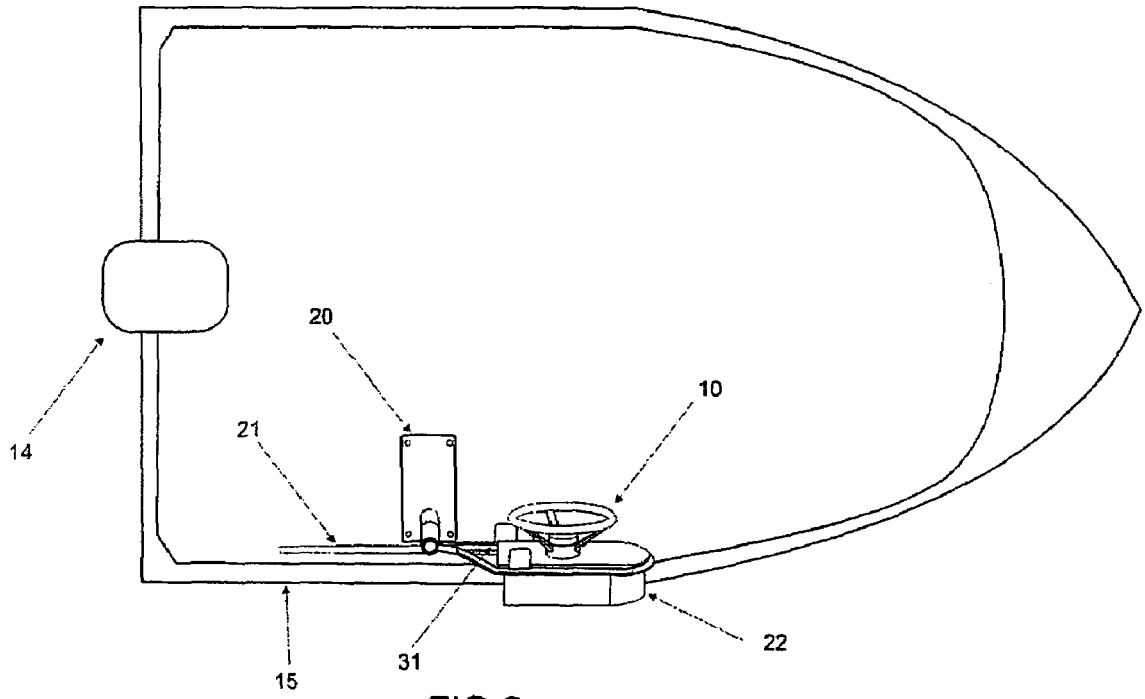
FIG. 2. Illustrates a plan view of FIG. 1 with the steering wheel in the swung away non use position.
Figure 3:
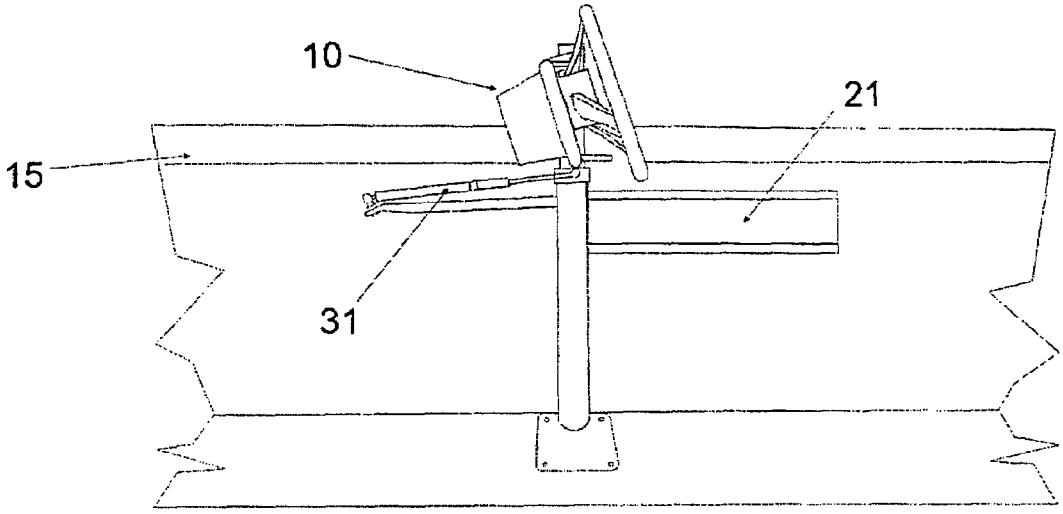
FIG. 3. Illustrates a side elevation view of the steering wheel assembly in the use position.
Figure 4:
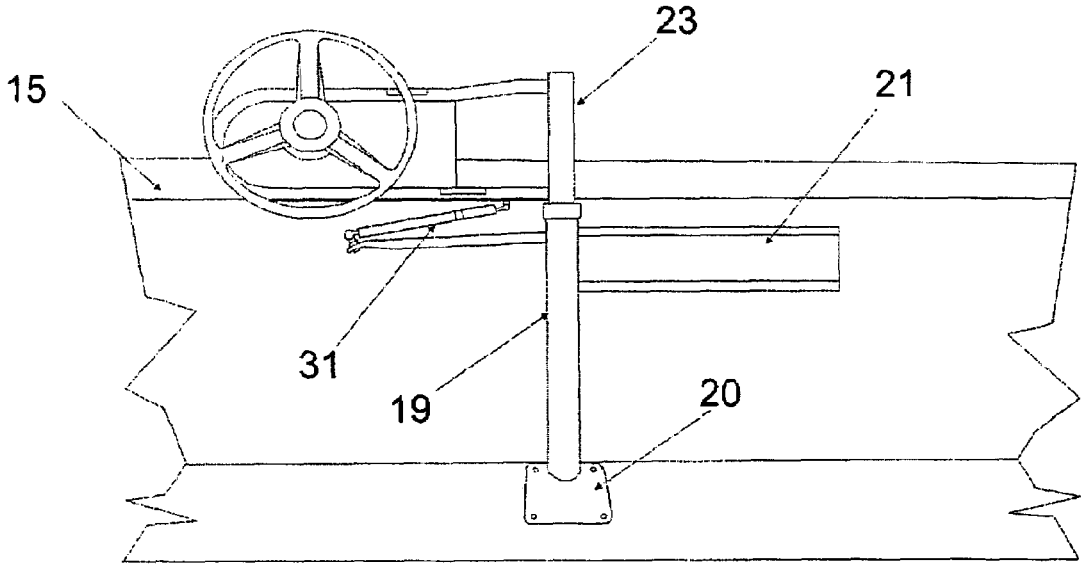
FIG. 4. Illustrates a side elevation view of the steering wheel assembly in the swung away non use position.
Figure 5:
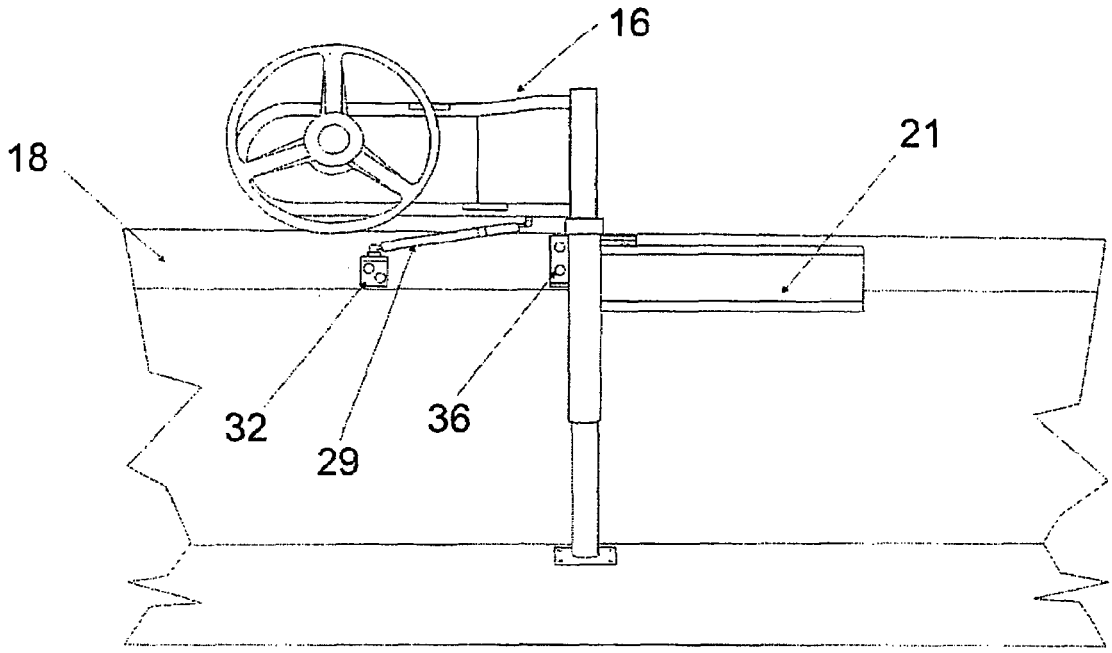
FIG. 5. Illustrates a steering wheel assembly of the second embodiment of the invention in a swung away non use position and on a wide gunnel boat.
Figure 8:
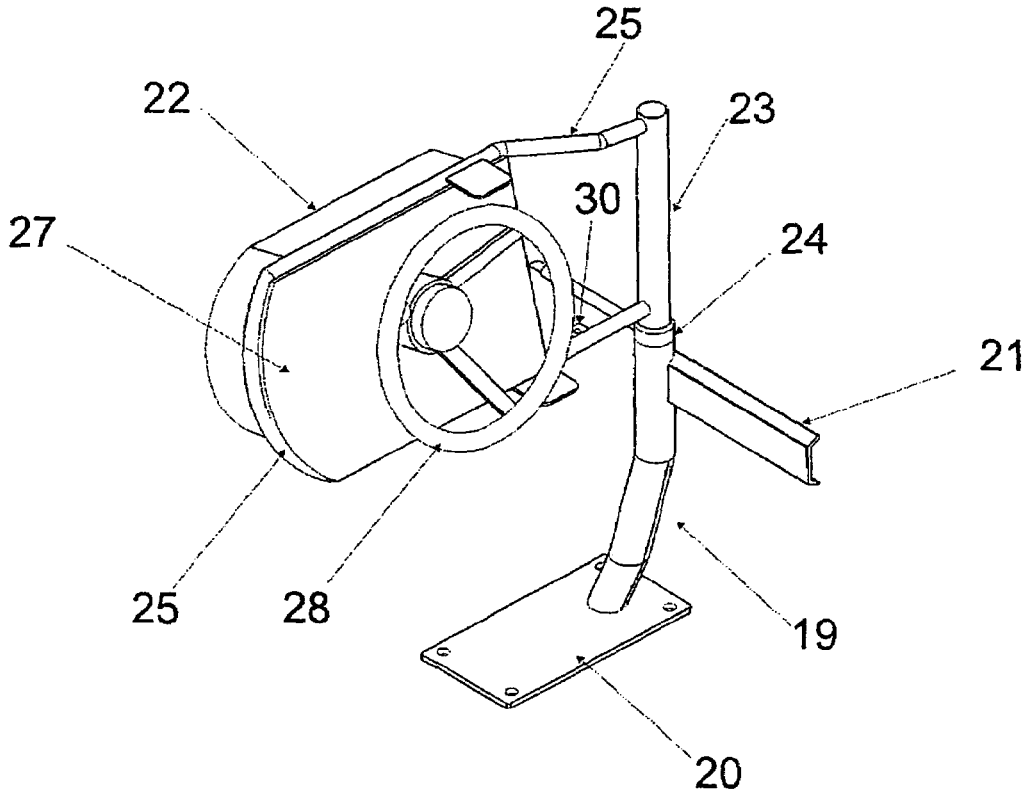
FIG. 8. Illustrates a front view of the first embodiment which is the steering wheel assembly on a narrow gunnel boat in the use position.
Figure 9:
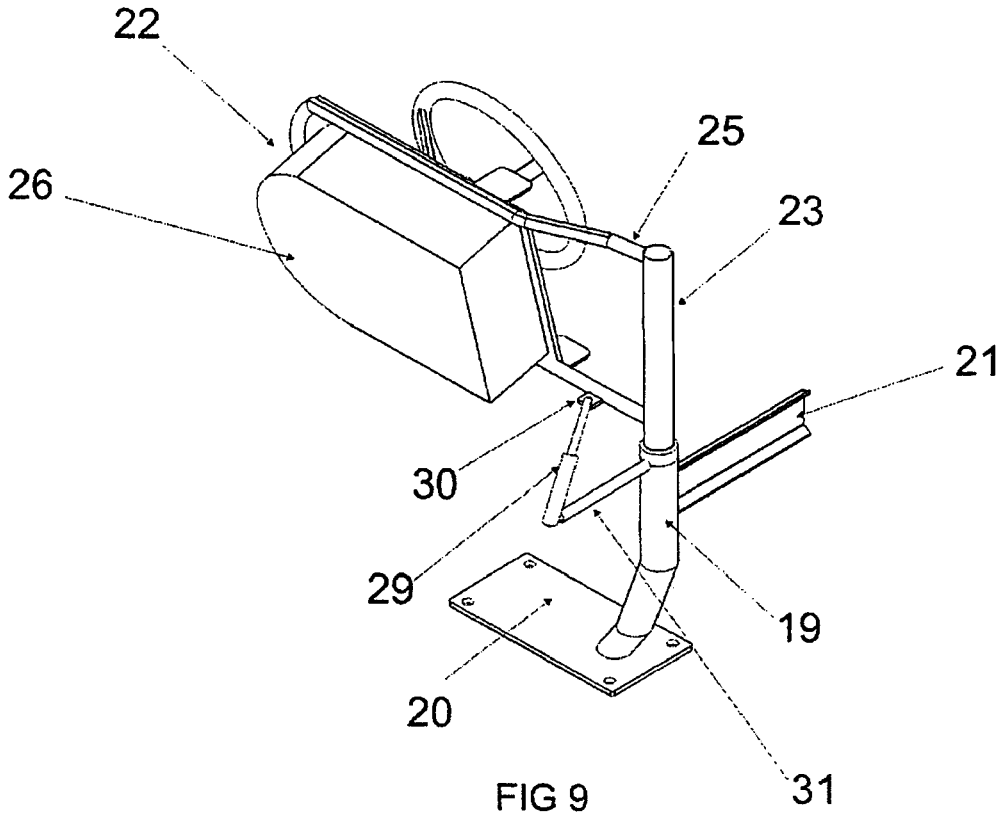
FIG. 9. Illustrates the rear view of the steering wheel assembly of FIG. 8.
Figure 10:
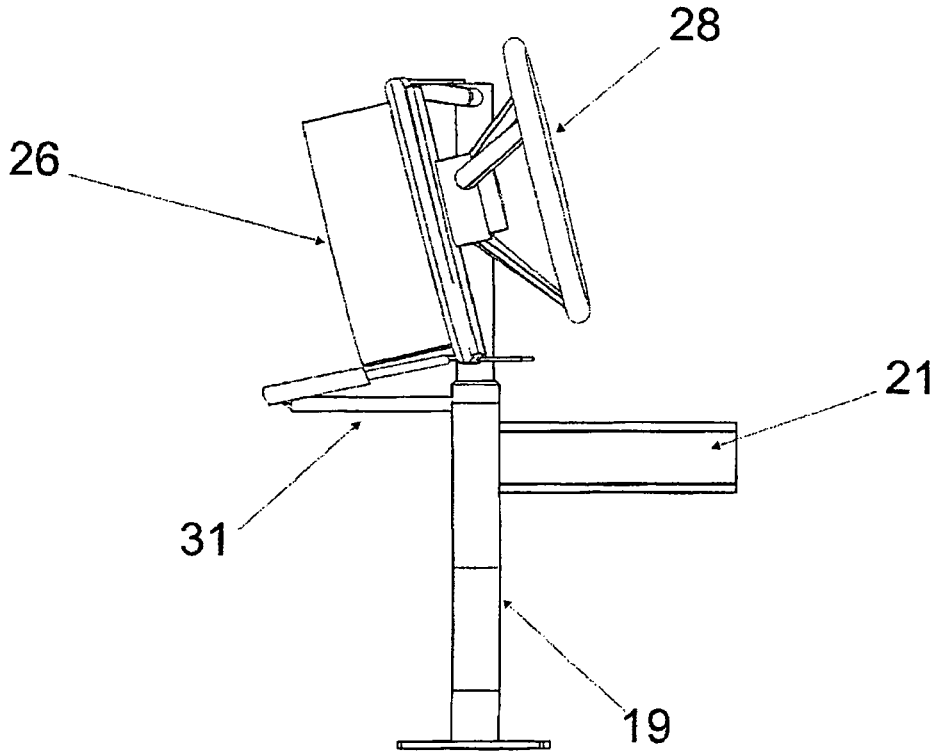
FIG. 10. Illustrates a side elevation view of the steering wheel assembly of FIG. 7 or FIG. 8.

The steering wheel assembly 10 for the narrow gunnel boat 11 is best described with reference to FIGS. 8-13. Referring initially to FIG. 8, FIG. 9 and FIG. 2 and there is illustrated the various components of the steering wheel assembly 10. These components can be made from any suitable material such as plastics, composite materials, steel, aluminum and the like. The assembly comprises a lower support which, in the particular embodiment, comprises an upright post 19. Post 19 is slightly curved (see particularly FIG. 8 and FIG. 9), to follow the curve of the side wall of the boat. Post 19 is formed from steel or aluminum which may be treated (typically galvanised for steel) to make it resistant to salt water. The post has a height of between 1 or 2 feet and is made of metal tube having a diameter of about 1-4 inches. The bottom of post 19 contains a floor plate 20 which is welded to the bottom of the post 19 and which is substantially rectangular. Plate 20 is a metal plate containing a number of openings to allow the floor plate to be bolted or screwed to the floor of the boat.

Adjacent the upper end of post 19 is a metal channel shaped plate member 21 which is approximately 8-24 inches long and extends at right angles to post 19 and parallel to the side wall of the boat. Plate member 21 functions as a support for the throttle controls of the boat. Therefore, plate 21 can also be seen as the throttle mounting plate. The throttle will be a conventional arrangement and the throttle is typically mounted to one side of the steering wheel and therefore the throttle mounting plate 21 is provided for this purpose. The mounting plate 21 is channel shaped such that the throttle control wires can be neatly hidden behind the mounting plate and between the mounting plate and the side wall of the boat.

Figure 20:
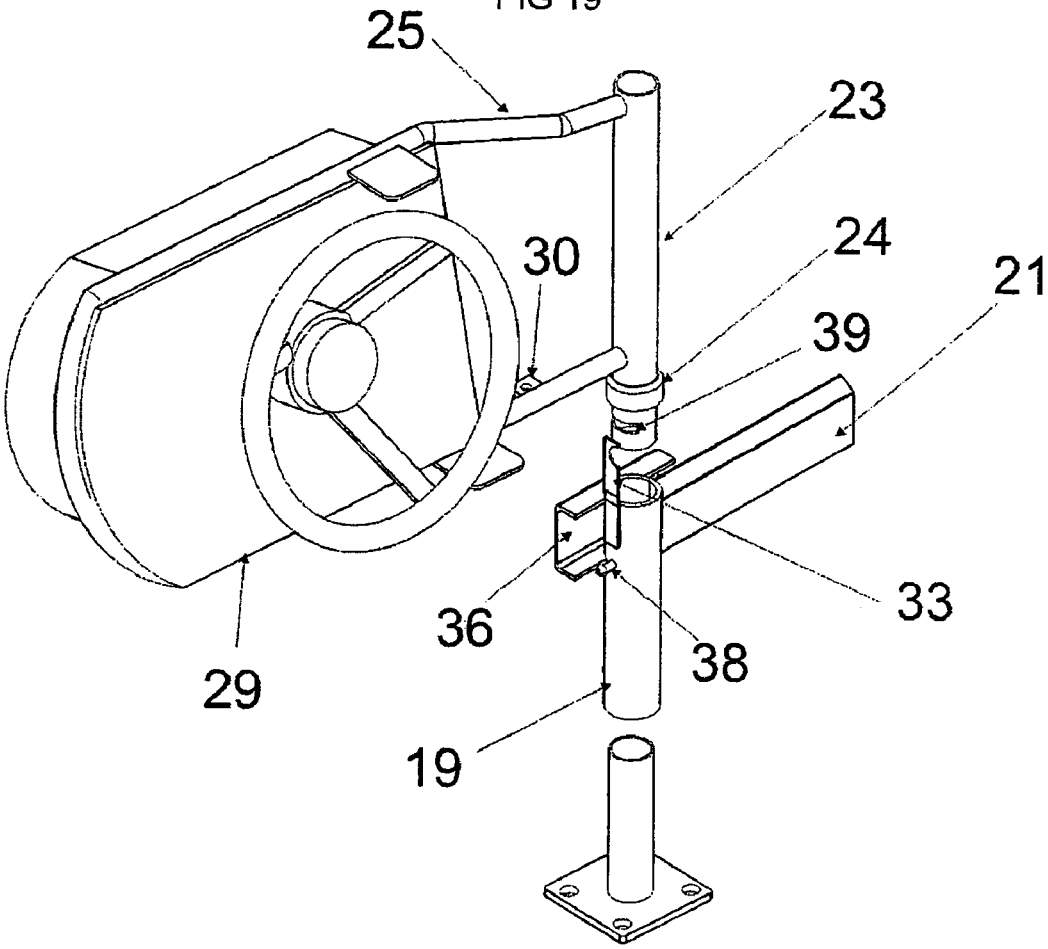
FIG. 20. Illustrates that the upper part of the steering wheel assembly can be releasably attached to the lower part of the steering wheel assembly and illustrates the upper part and the lower part separated from each other.

The upper end of post 19 is open and hollow, and this supports the upper support which is pivotally attached to the lower support (post 19). The upper support comprises an upper post 23 which is also made from a hollow metal tube. The lower end of the upper post is a smaller diameter, and the open upper end of lower post 19 is such that the upper post sits within the lower post. A collar 24 is welded to the upper post to provide a stop. The upper post can therefore swing or pivot about the lower post. The lower post is fixed (typically bolted to the floor of the boat) and the upper post can swing typically about 110° relative to the fixed lower post. These details are also illustrated in FIG. 20. Upper post has a length of between 8-16 inches.

Attached to the upper post is the dashboard/console 22. Dashboard 22 comprises a substantially U-shaped steel tubular arm member 25. The free ends of the U-shaped tubular arm member 25 are welded to the upper post 23. The dashboard has a length (that is the distance between upper post 23 and the outer edge of the dashboard) of between 2-4 feet. The height of the dashboard (that is the distance between the arm members 25) is about 12-18 inches. The "depth" of the dashboard is about 4 or 5 inches. Dashboard 22 has a rear cover 26 (see FIG. 9 and FIG. 10) formed from sheet metal or aluminum, and has a front cover 27 (see FIG. 8) also formed from sheet metal/aluminum.

A steering wheel 28 is attached to the front of the dashboard. The steering wheel is connected to the steering mechanism which is inside the dashboard and which can comprise a conventional arrangement which is typically some form of wheel or plate like member inside the dashboard to which the control wires are attached. The control wires connect to an attachment on the outboard motor 14 to turn the outboard motor upon turning of the wheel. This arrangement is quite conventional.

The dashboard can also be seen as a "console".

The dashboard can freely rotate about lower post 19. However, complete free rotation is not desired and therefore a biasing member is provided to control the swinging ability of the dashboard. The biasing member comprises a gas strut 29 which is clearly illustrated in FIG. 9 and FIG. 13. Gas strut 29 functions to bias the dashboard into the extended use position illustrated in at least FIG. 8 and FIG. 13 and also FIG. 1.

Gas strut 29 has one end attached to the dashboard at a particular mounting point 30. Mounting point 30 is on the lower arm member 23 and is spaced approximately 6 inches from upper post 23. Mounting point 30 is illustrated at least in FIG. 9.

The other end of gas strut 29 is mounted to a mounting arm 31. Mounting arm 31 comprises a metal tubular member welded to an upper part of post 19. Mounting arm 31 extends from post 19 at an angle which is about 90° relative to the dashboard when the dashboard is in the use position (see for instance FIG. 9). With this arrangement, the gas strut provides a cushioning or biasing force to hold the dashboard in the use position. Another advantage of this arrangement is that should a person be thrown against the dashboard in rough seas, the gas strut will absorb the force to reduce injury to the person.

Figure 11:
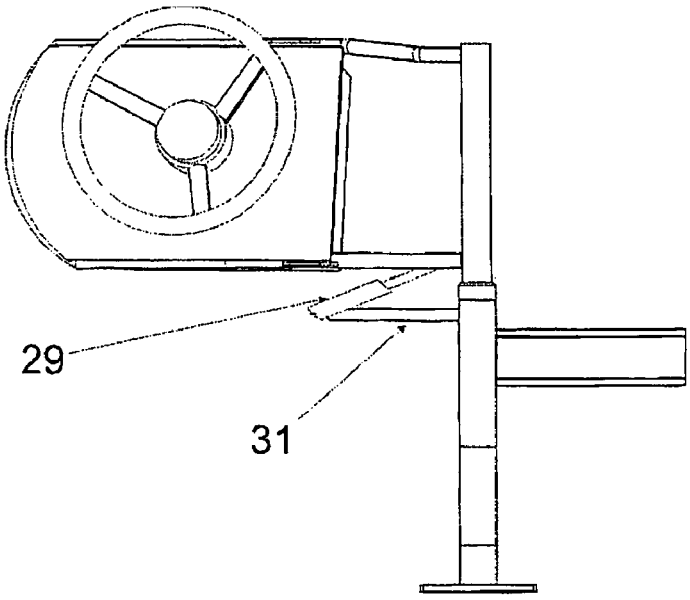
FIG. 11. Illustrates a side elevation view of the steering wheel of FIG. 10 in the swung away position (see also FIG. 2 which is the plan view).
Figure 12:
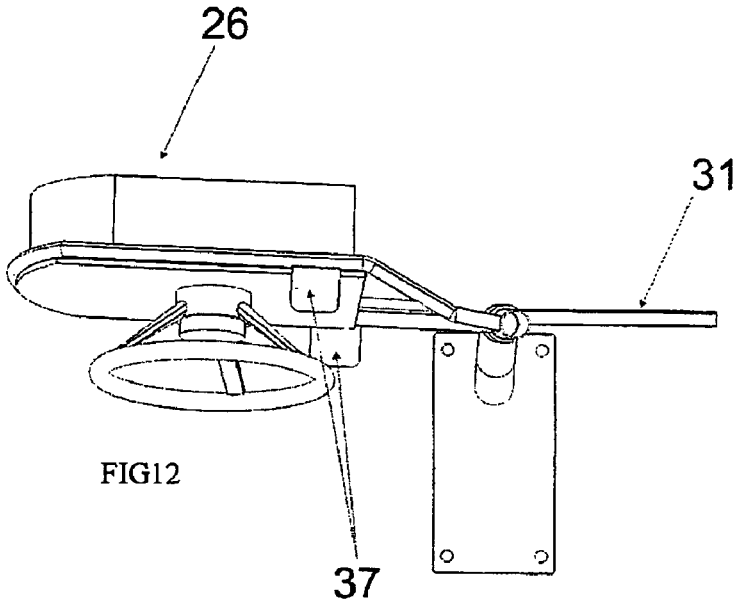
FIG. 12. Illustrates a plan view of the steering wheel assembly in the swung away non use position (e.g.
Figure 13:
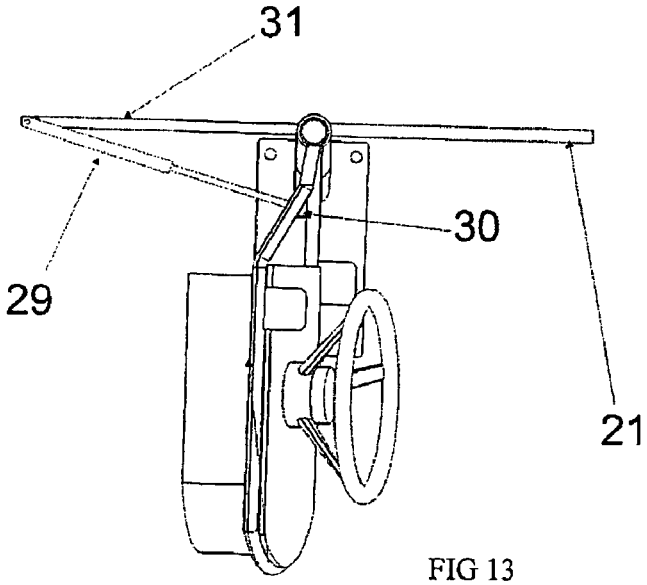
FIG. 13. Illustrates a plan view of the steering wheel assembly of FIG. 12 in the use position.
Figure 14:
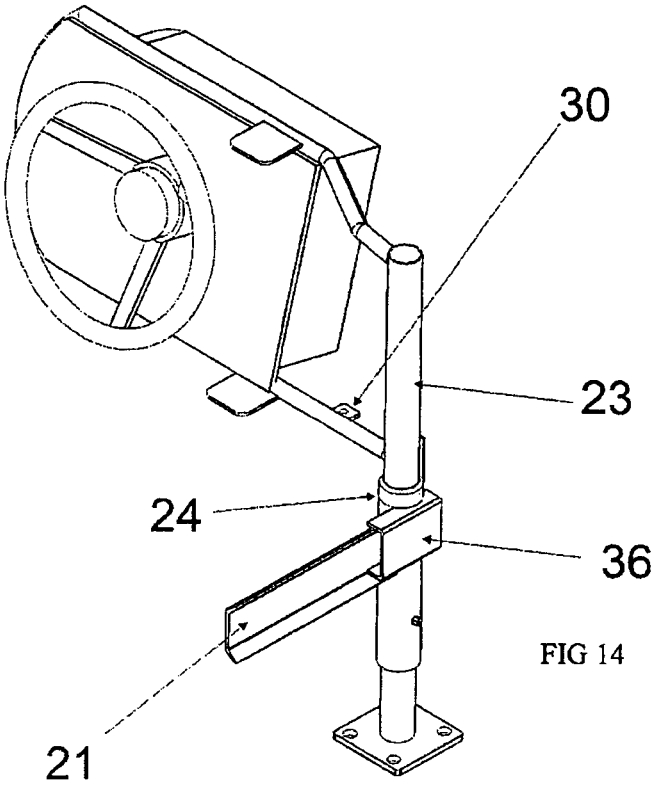
FIG. 14. Illustrates the steering wheel assembly of the second embodiment (used on a wide gunnel boat) and illustrates a front view of the steering wheel assembly in the use position (see also FIG. 6 which is the plan view of the steering wheel assembly on a wide gunnel boat in the use position).
Figure 15:
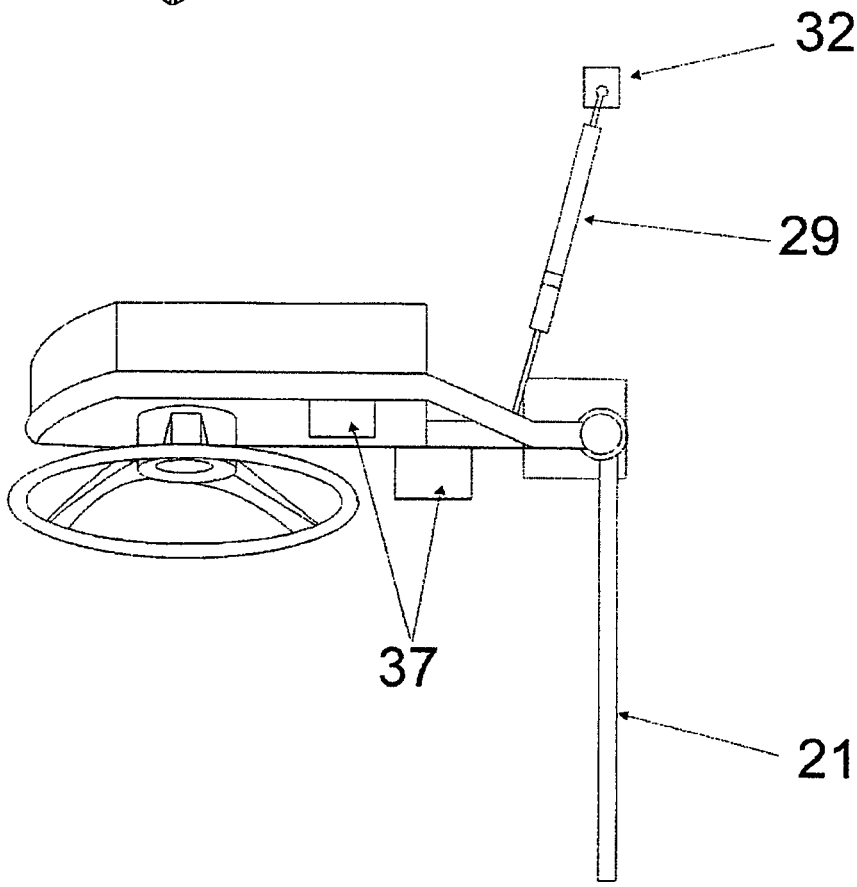
FIG. 15. Illustrates a plan view of the steering wheel assembly of FIG. 14.
Figure 16:
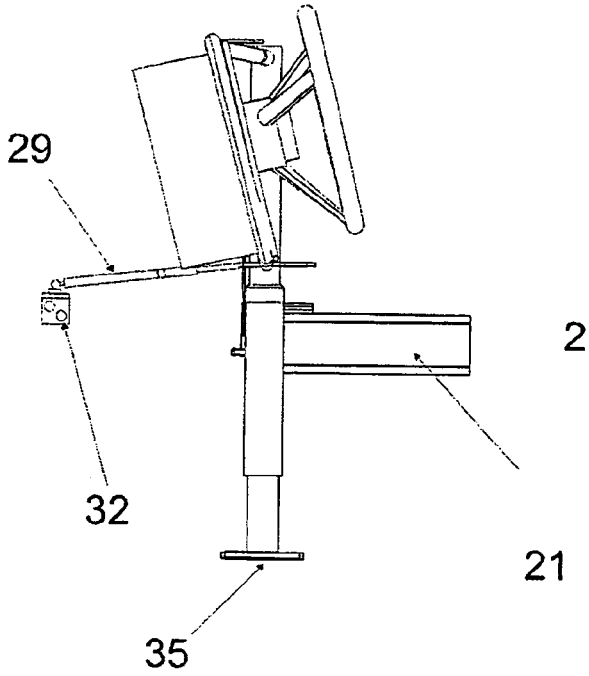
FIG. 16. Illustrates a side elevation view of the steering wheel assembly of FIG. 14 and FIG. 15 (still in the use position).
Figure 18:
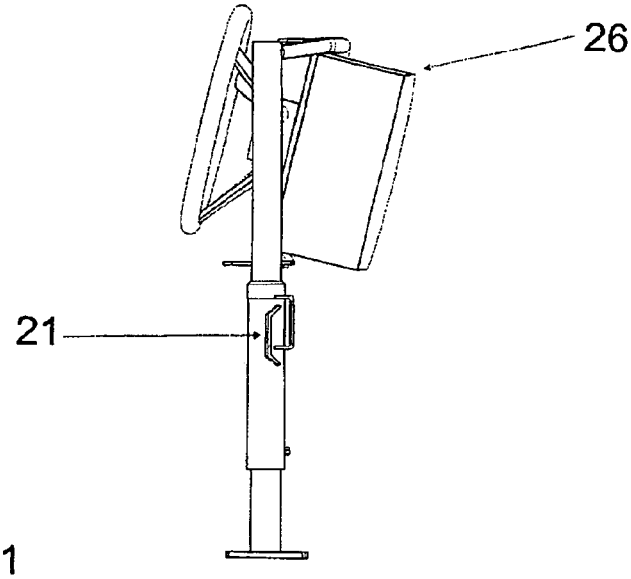
FIG. 18. Illustrates a front view of the steering wheel assembly swung away into the nonuse (folded) position.
Figure 17:
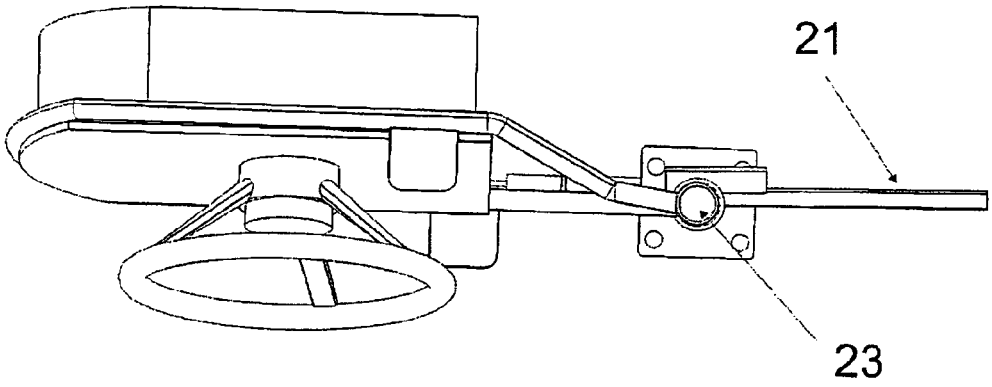
FIG. 17. Illustrates a plan view of the steering wheel assembly swung away into the nonuse position (see also FIG. 7 which is the plan view).

The dashboard 22 can be pushed against the bias of the gas strut 29 into the swung away position illustrated, for instance, in FIG. 11 and FIG. 12. In this swung away position, the dashboard is against the side wall of the boat which is illustrated in FIG. 2. The gas strut 29 can also function to hold the dashboard into the swung away position by adopting a slightly "over centre" type position. To explain, when the dashboard is pushed into the swung away position, the positioning and configuration of the steering wheel assembly is such that the mounting point 30 will swing past the mounting arm 31 by a small distance (typically a few inches). This position is illustrated in FIG. 11 and FIG. 12. As soon as the mounting point swings past the mounting arm, the gas strut will again extend to provide a pushing force against the dashboard. This pushing force will now be on the other side of the mounting arm 31 and will result in pushing the dashboard against the gunnel of the boat. Thus, by providing this particular configuration, the single gas strut can function to hold the dashboard both in the use position and also in the swung away nonuse position.

Referring now to the slightly modified steering wheel assembly for use with a wide gunnel. The steering wheel assembly is illustrated in FIGS. 14-19. The steering wheel assembly 16 is almost identical to the assembly described with reference to the narrow gunnel model with the principal difference being the attachment of the gas strut. The gas strut 29 has one end again attached to the same mounting point 30 as with the narrow gunnel model, but the other end of the gas strut is attached to a small mounting plate 32 which is screwed or otherwise fastened to the wide gunnel of the boat. This arrangement is illustrated at least in FIG. 7. Thus, the steering wheel assembly for use with a wide gunnel boat does not have the gas strut mounting arm 31.

The dashboard 22 can again be held in the use position by the gas strut 29 and can again be pushed into the swung away position against the action of the gas strut 29. An over centre mechanism is again employed. Thus, the dashboard can be pushed over the top of gunnel 18 (see FIG. 7), until the mounting point 30 has passed over the top of mounting plate 32. In the narrow gunnel version, the dashboard is prevented from swinging entirely out of the boat by striking the edge of the narrow gunnel. In the broad gunnel version, the dashboard swings over the top of the gunnel and therefore must be prevented from swinging entirely out of the boat.

Figure 19:
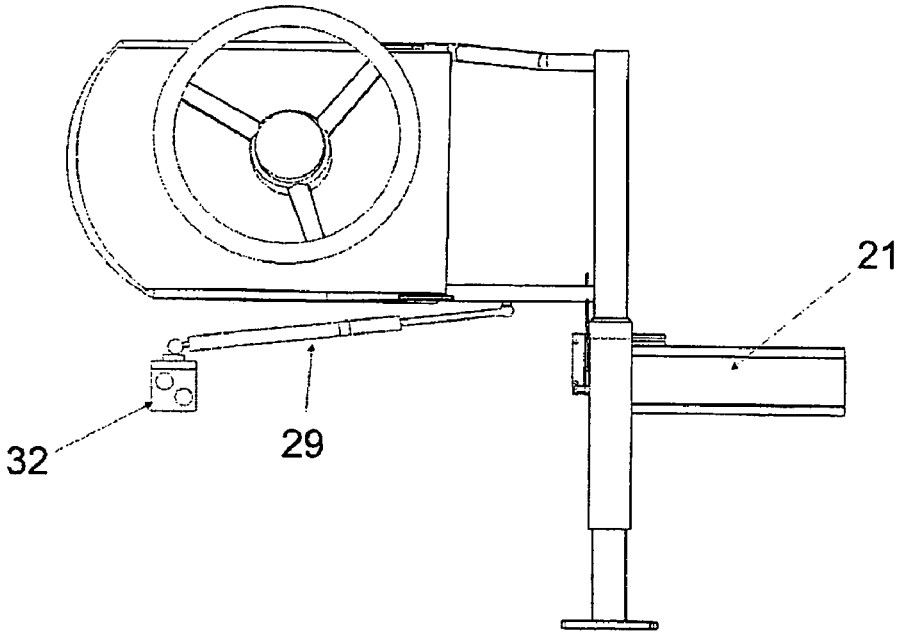
FIG. 19. Illustrates a side of the steering wheel assembly swung away in the nonuse (folded) position.
Figure 22:
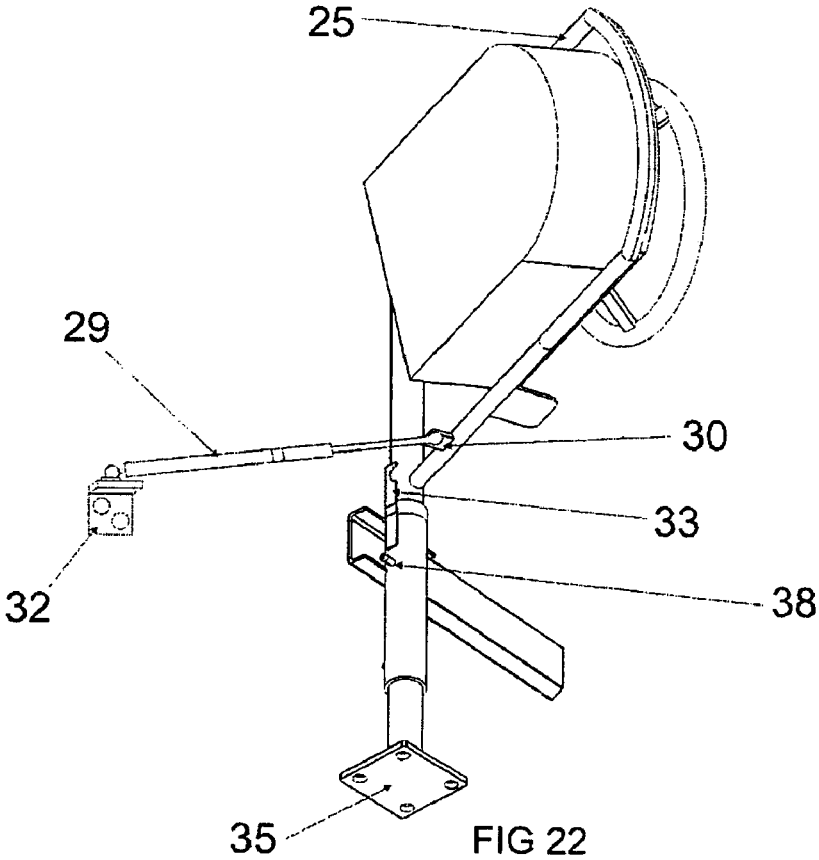
FIG. 22. Illustrates an upper view of the second embodiment of the steering wheel assembly and particularly illustrating a limit member to prevent over swinging of the steering wheel assembly.

This is achieved by using a limit member 33. The limit member 33 is clearly illustrated in FIG. 22 and FIG. 23 and is also illustrated in FIG. 19 and FIG. 20. The limit member comprises a metal plate having a length of about 6 inches. The lower part of limit member 33 is welded to the outside of the lower post 19 (see FIG. 23), such that limit member 33 is rigid relative to post 19. The upper part of limit member 33 comprises a curved recess 34 which is designed to catch the lower arm member 25 of the dashboard. Thus, the dashboard can swing to the slightly over centre retracted position and the lower arm member 25 of the dashboard can then locate within the recess 34 to prevent any further retraction. In this retracted position, the dashboard is as illustrated in FIG. 7.

In the wide gunnel version of the invention, the lower post 19 has a much smaller floor plate 35 (see for instance FIG. 14), and therefore lower post 19 is also bolted to the wide gunnel by further mounting plates 36 which are illustrated at least in FIG. 14, FIG. 21, FIG. 22 and FIG. 23.

The dashboard containing the upper post 23 can be removed from the lower post 19 which remains fixed to the boat. This provides a measure of security. Also, the dashboard can contain various other expensive items such as depth finders, global positioning system units etc which can be fastened to small mounting plates 37 on the dashboard. The mounting plates are illustrated at least in FIG. 12, FIG. 13, and FIG. 21.

Figure 21:
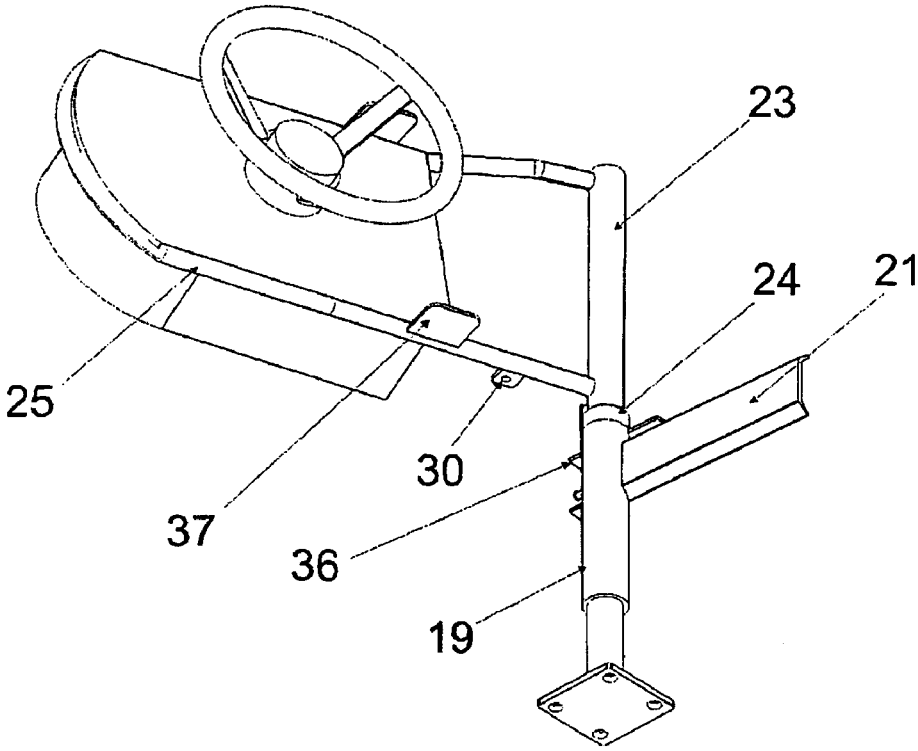
FIG. 21. Illustrates the upper part and the lower part of the steering wheel assembly connected.
Figure 23:
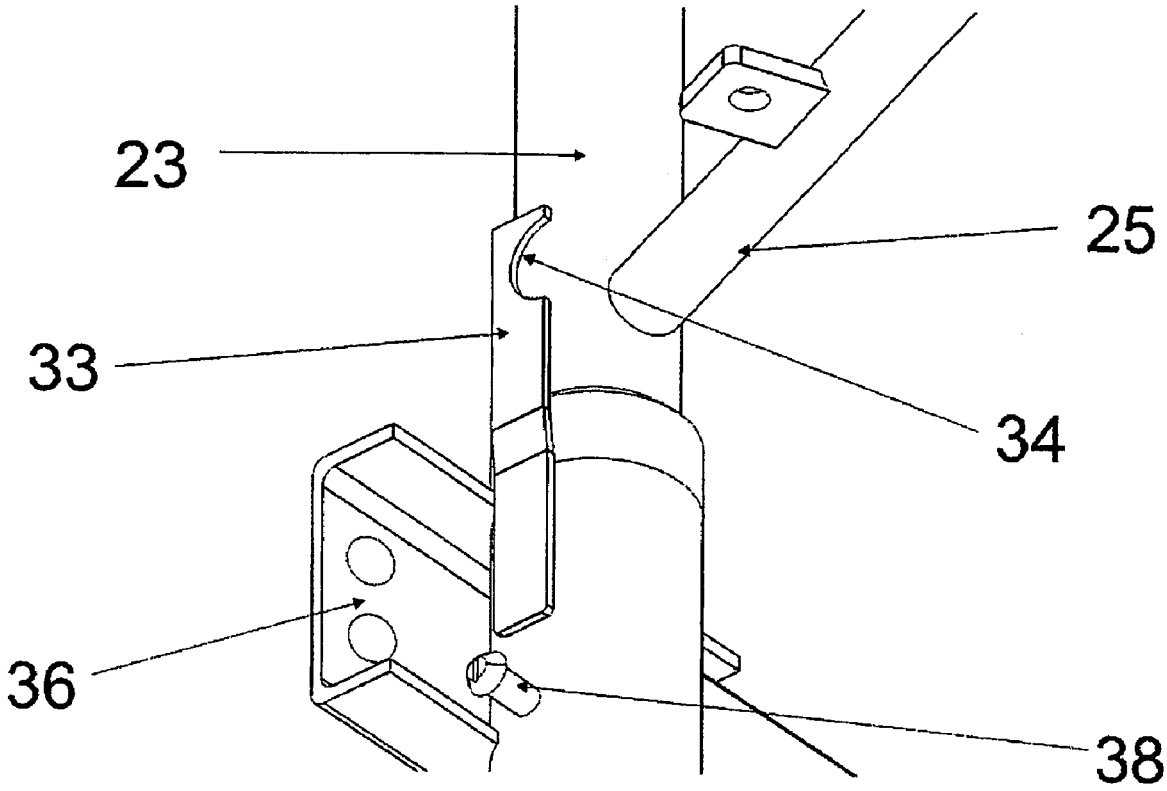
FIG. 23. Illustrates the limit member in greater detail.

The upper post can be lifted out of the lower post 19. FIG. 20 illustrates the upper post lifted out of the lower post and FIG. 21 illustrates the upper post dropped into the lower post 19 with the collar 24 sitting on top of, and rotating about, the lower post 19. However, to stop inadvertent removal of the upper post (and therefore dashboard), a small locking bolt 38 is provided. Locking bolt 38 is illustrated in FIG. 23 and extends through an opening in the upper end of lower post 19. However, to still allow the upper post to swing relative to the lower post, the lower end of the upper post is formed with a part circumferential slot 39 which is illustrated in FIG. 20. The threaded end of the bolt passes into slot 39 which enables the upper post to swing relative to the lower post prevent the upper post from being lifted out of the lower post. The length of slot 39 can also assist in limiting the swinging motion of the upper post.

Throughout the specification and claims unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A steering assembly for a boat which is swingable between a use position where the steering assembly extends into the boat, and a retracted position where the steering assembly is adjacent a side of the boat, the steering assembly comprising:

(a) a lower support adapted for attachment to the boat, (b) an upper support pivotally attached to the lower support for pivotal movement about a substantially vertical axis, (c) a dashboard attached to the upper support, (d) a steering device supported by the dashboard, and, (e) a biasing member attached to the dashboard and to a fixed position on the boat, the dashboard and the upper support being swingable relative to the lower support between a use position where the dashboard containing the steering device extends into the boat and a retracted position where the dashboard containing the steering device is against the side of the boat, the biasing member biasing the dashboard into the use position.

2. The steering assembly as claimed in claim 1 wherein the lower support comprises an upright post, a floor plate attached to a lower part of the upright post, the floor plate being attachable to a boat floor, the post being fixed in position and unable to rotate or otherwise move.

3. The steering assembly as claimed in claim 2 wherein the steering device comprises a steering wheel.

4. The steering assembly as claimed in claim 3, wherein the biasing member comprises a gas strut.

5. The steering assembly as claimed in claim 4 and for use in a narrow gunnel boat, the assembly comprising a gas strut mounting arm extending outwardly from the upright post and fixedly attached to the upright post, one end of the gas strut being attached to the gas strut mounting arm and the other end of the gas strut being attached to the dashboard, the gas strut mounting arm extending substantially at right angles relative to the dashboard when the dashboard is in the use position.

6. The steering assembly as claimed in claim 5, wherein the gas strut is attached to the dashboard at a mounting point, the mounting point being positioned on the dashboard such that as the dashboard is swung from the extended use position to the retracted nonuse position, the mounting point passes from one side of the mounting arm to the other side of the mounting arm to provide an over center mechanism, thereby biasing the dashboard both in the retracted nonuse position and in the extended use position.

7. The steering assembly as claimed in claim 4 for use with a wide gunnel boat, wherein one end of the gas strut is attached to the dashboard and the other end of the gas strut is fixed relative to the gunnel of the boat.

8. The steering assembly as claimed in claim 7, wherein the dashboard extends at least partially over the top of the gunnel when the dashboard is in the nonuse position.

9. The steering assembly as claimed in claim 8, wherein the gas strut is attached to the dashboard and a mounting point, the mounting point being positioned on the dashboard such that as the dashboard is swung from the extended use position to the retracted nonuse position, the mounting point extends past the attachment of the gas strut relative to the gunnel of the boat to provide an over center mechanism thereby biasing the dashboard both in the retracted nonuse position and in the extended use position.

10. The steering assembly as claimed in claim 9, containing a limit member which prevents the dashboard from swinging entirely past the wide gunnel.

11. The steering assembly as claimed in claim 10, wherein the limit member comprises a rigid elongate finger, a lower end of which is fixed to the lower post and an upper end of which abuts against part of the dashboard when the dashboard is swung into the retracted nonuse position to prevent over rotation of the dashboard.

12. The steering assembly as claimed in claim 2, wherein the upper support can be removed from the lower support thereby enabling the dashboard and the steering device to be removed from the boat.

13. The steering assembly as claimed in claim 2, wherein the post of the lower support has an open upper end, and the upper support to which the dashboard is attached has a lower end which passes into the open upper end of the lower support to enable the upper support to swing relative to the lower support and which enables the upper support to be removed from the lower support.

14. The steering assembly as claimed in claim 13, including a locking member to lock the upper support to the lower support, the locking member comprising a threaded fastener which passes through an opening in the lower support, the upper support having a lower part circumferential slot into which the threaded fastener can locate thereby enabling the upper part to swing relative to the lower part but preventing the upper part from being lifted out of the lower part.

15. The steering assembly as claimed in claim 2 including an elongate throttle mounting plate attached to the upright post and extending substantially parallel to the boat gunnel, the throttle mounting plate enabling a throttle to be mounted to the mounting plate.

* * * * *